US007621251B1

(12) United States Patent
Courant et al.

(10) Patent No.: US 7,621,251 B1
(45) Date of Patent: Nov. 24, 2009

(54) LUBRICATION COOLING SYSTEM FOR A VEHICLE

(75) Inventors: Timothy J. Courant, Chisago City, MN (US); Michael R. Trihey, Roseau, MN (US)

(73) Assignee: Polaris Industries Inc., Medina, MN (US)

( * ) Notice: Subject to any disclaimer, the term of this patent is extended or adjusted under 35 U.S.C. 154(b) by 507 days.

(21) Appl. No.: 11/372,593

(22) Filed: Mar. 10, 2006

(51) Int. Cl.
*F01M 1/02* (2006.01)

(52) U.S. Cl. ..... 123/196 AB; 184/104.3

(58) Field of Classification Search ..... 123/41.33, 123/196 R, 196 AB; 184/104.3
See application file for complete search history.

(56) References Cited

U.S. PATENT DOCUMENTS

| | | | | |
|---|---|---|---|---|
| 2,598,849 | A * | 6/1952 | Sonderegger | 123/41.33 |
| 4,971,171 | A | 11/1990 | Yamada et al. | |
| 5,307,865 | A | 5/1994 | Inagaki et al. | |
| 5,351,664 | A * | 10/1994 | Rotter et al. | 123/196 AB |
| 5,645,125 | A | 7/1997 | Kroetsch et al. | |
| 5,647,315 | A | 7/1997 | Saito | |
| 5,715,778 | A | 2/1998 | Hasumi et al. | |
| 5,809,963 | A | 9/1998 | Saito | |
| 6,418,887 | B1 | 7/2002 | Okamoto | |
| 6,470,847 | B2 | 10/2002 | Kawamoto | |
| 6,554,664 | B1 | 4/2003 | Nanami | |
| 6,715,460 | B2 | 4/2004 | Ashida et al. | |
| 2005/0092266 | A1 | 5/2005 | Oshima et al. | |

FOREIGN PATENT DOCUMENTS

JP 55046008 A * 3/1980

* cited by examiner

*Primary Examiner*—Noah Kamen
(74) *Attorney, Agent, or Firm*—Baker & Daniels LLP

(57) ABSTRACT

A vehicle is disclosed that includes a chassis, a traction device adapted to contact the ground and propel the chassis and an engine supported by chassis and providing power to traction device. The engine includes a housing, a lubricant, and an engine component external of the engine housing. The housing includes a first lubricant inlet passage, a first lubricant outlet passage, a second lubricant inlet passage, and a second lubricant outlet passage. The vehicle has a first configuration in which first the lubricant outlet passage provides lubricant to the external engine component, the first lubricant inlet passage receives the lubricant from engine component, the second lubricant outlet passage is blocked with a plug, and the second lubricant inlet passage is blocked with a plug.

19 Claims, 11 Drawing Sheets

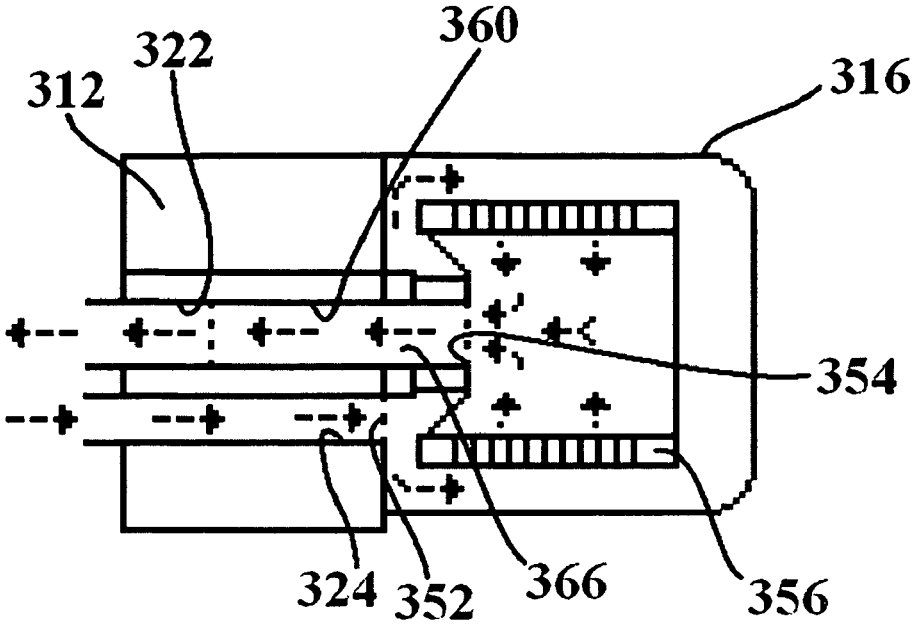
FIG. 10A – PRIOR ART
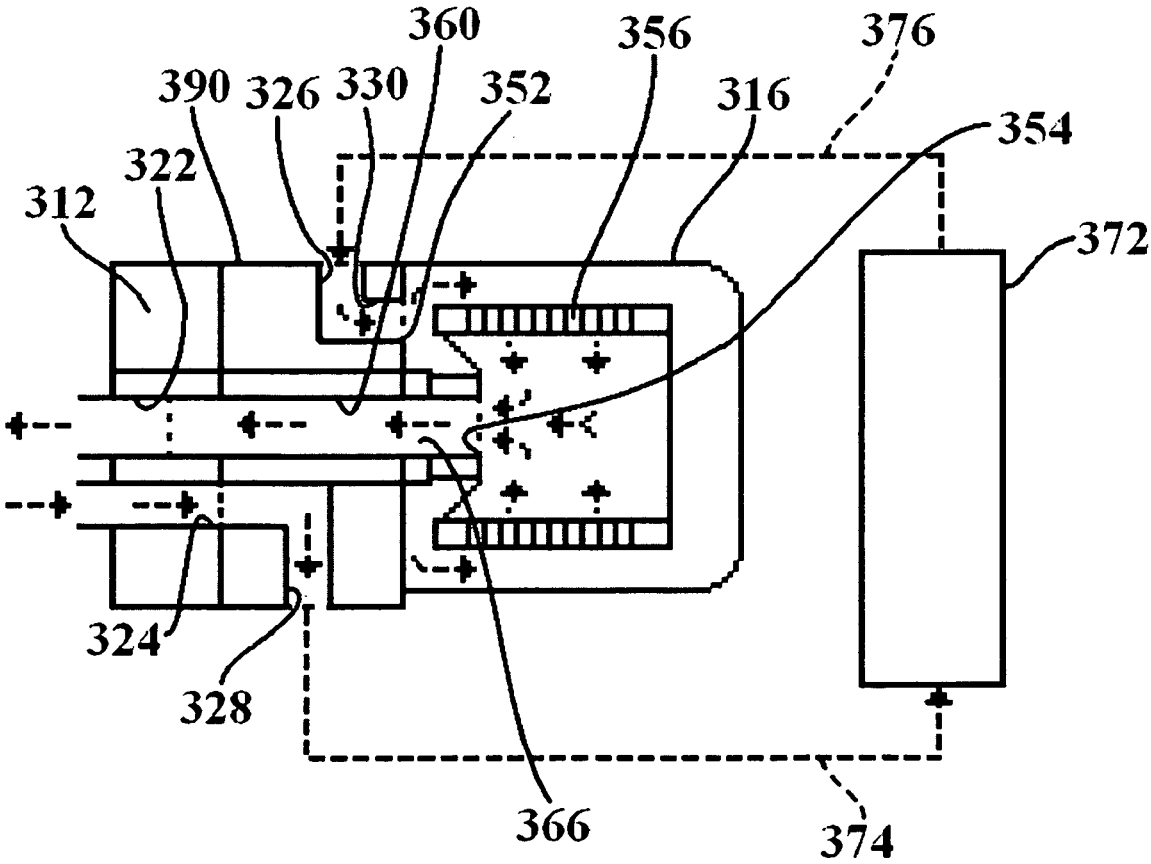
FIG. 10B – PRIOR ART

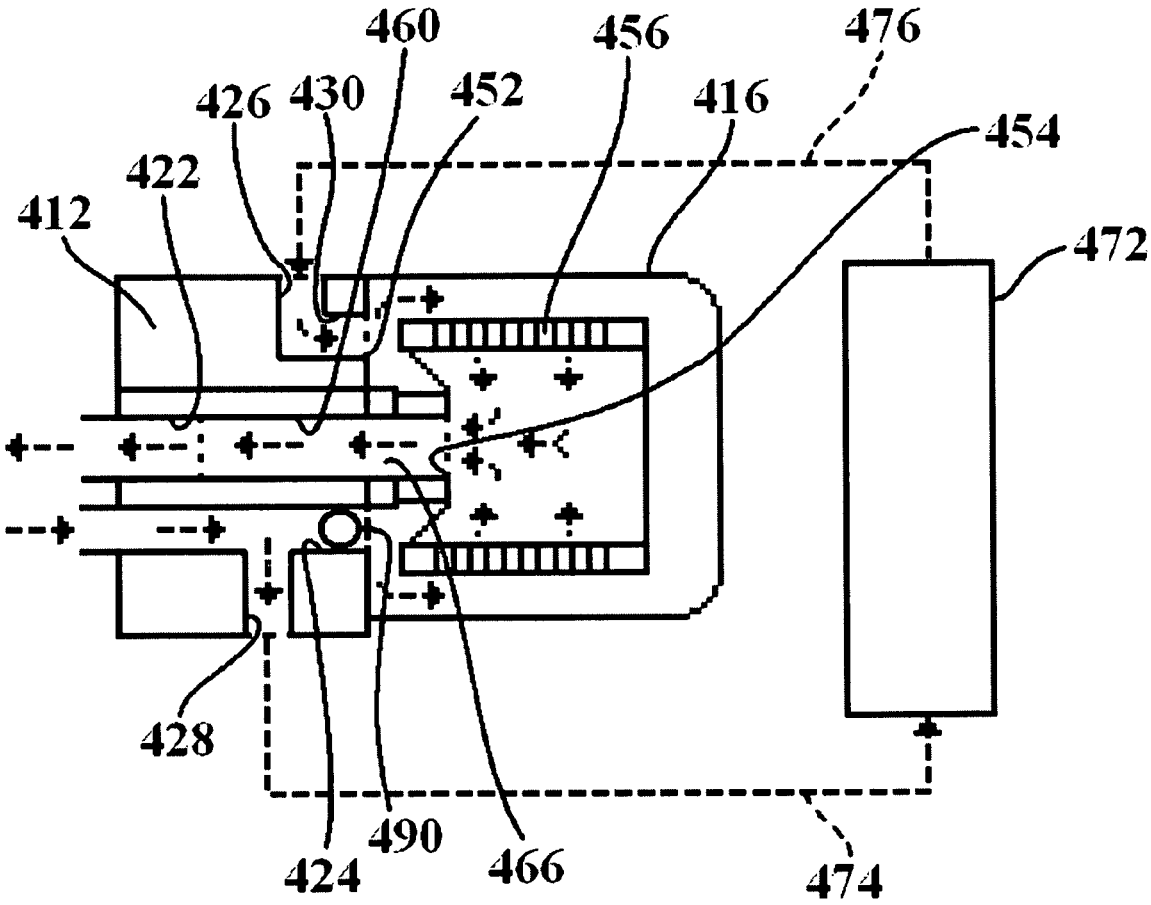
FIG. 10C – PRIOR ART

LUBRICATION COOLING SYSTEM FOR A VEHICLE

FIELD OF THE INVENTION

The present invention relates to vehicles having lubrication cooling systems and, more particularly, to vehicles having engines coupled to a lubrication system.

BACKGROUND OF THE INVENTION

Known engines typically include, among other things, an engine housing defining an interior volume, which houses the moving parts of the engine. A lubricant is typically contained within the interior volume of the housing and serves to lubricate the moving parts of the engine. The engine also commonly includes a lubricant filter mounted on the engine housing and fluidly coupled with the interior volume of the engine housing. The lubricant circulates between the interior volume of the housing and the filter to continuously filter debris from the lubricant.

In certain operating conditions, the lubricant may reach extremely high temperatures, and it may be desirable to cool the lubricant circulating through the engine. This is often achieved by coupling a remote lubricant cooler device or heat exchanger to the engine housing and bypassing the flow of the lubricant such that the lubricant flows through the cooler prior to entering the filter. This commonly involves the installation of an adapter which couples with external inlet and outlet cooler lines to redirect the lubricant to the cooler. The installation of the adapter involves removing the filter and mounting the adapter in its place. The filter is then mounted on the adapter. The inlet and outlet cooler lines are usually in the form of hoses which are coupled to the adapter. When the adapter is mounted on the engine housing and coupled with the cooler, the lubricant flows from the engine housing to the adapter, then to the cooler. From the cooler, the lubricant flows back to the adapter, then to the filter and back to the engine housing. Of course, the lubricant flow could be reversed such that the lubricant is filtered prior to being cooled. Unfortunately, the installation of the adapter and external cooling lines adds cost, weight and manufacturing time to the production of the vehicle. For instance, the cooling lines are installed and routed after the engine is mounted in the vehicle, thus, adding cost and manufacturing time. In addition, the cooling lines may need to be replaced due to wear, therefore, reducing the longevity of the vehicle and creating added maintenance expense. Furthermore, in some cases it may be desirable to install and remove the cooler as the operating conditions change. However, the installation of the cooler may be too cumbersome and impractical for such temporary applications.

An engine housing has been developed that includes built-in bypass channels for coupling with a remote cooler without the use of an adapter. In this case, when lubricant cooling is desired, a steel ball is pressed into the passage leading to the filter to thereby block the flow of lubricant to the filter and re-direct the flow of lubricant to the bypass channels. However, it may be difficult to press and seal the ball in the passage and, once the ball is pressed in the passage, it may be difficult to remove and convert the engine to bypass the cooler when lubricant cooling is not needed.

SUMMARY OF THE INVENTION

The present invention provides a vehicle having an improved lubrication cooling system. In one form, a vehicle includes a chassis, a traction device, and an engine. The traction device is adapted to contact the ground and propel the chassis. The engine is supported by the chassis and provides power to the traction device. The engine includes an engine housing, a lubricant, and a first engine component external of the engine housing. The engine housing includes a first lubricant passage, a second lubricant passage, a third lubricant passage, and a fourth lubricant passage. The vehicle has a first configuration in which the second lubricant passage communicates lubricant with the engine component, the first lubricant passage communicates lubricant with the first engine component, the fourth lubricant passage is blocked with a plug, and the third lubricant passage is blocked with a plug. The vehicle has a second configuration in which the second lubricant passage is plugged with at least one of the plugs, the fourth lubricant passage communicates lubricant with a second engine component external of the engine housing, and the third lubricant passage communicates lubricant with the second engine component.

In yet another form, the vehicle includes a chassis and an engine supported by the chassis and providing power to the propel the chassis. The engine includes an engine housing, a lubricant and a lubricant cooler mounted on the engine housing. The lubricant cooler includes a cooler housing defining an interior space for the lubricant and a plurality of heat fins dissipating heat from the lubricant to air passing over the heat fins.

In still another form, a vehicle includes an engine housing, a first lubricant cooler, and a lubricant fluid. The engine provides power to propel the vehicle. The engine includes an engine housing defining an interior volume. The engine housing includes a first passage in fluid communication with the interior volume, a second passage in fluid communication with the interior volume, a third passage, a fourth passage in fluid communication with the interior volume, and a fifth passage in fluid communication with the second lubricant inlet passage. The first lubricant cooler is mounted on the engine housing. The first lubricant cooler includes a cooler housing defining an interior space and a plurality of heat fins. The interior space of the cooler housing is in fluid communication with the second and fifth passages. The lubricant fluid circulates between the interior volume of the engine housing and the interior space of the cooler housing. The vehicle is convertible between a first configuration and a second configuration. In the first configuration, each of the third and fourth passages are blocked with a plug and the lubricant fluid flows between the interior volume and the interior space via the second passage. The plurality of heat fins dissipate heat from the lubricant fluid in the interior space of cooler housing to air passing over the plurality heat fins. The first passage communicates lubricant fluid with the interior volume. In the second configuration, the second passage is blocked with one of the plugs. The third and fourth passages are fluidly and remotely engagable with a second lubricant cooler. The fourth passage is capable of communicating the lubricant fluid from the interior volume to the second lubricant cooler. The third passage is capable of communicating lubricant with the second lubricant cooler and the interior space of the first lubricant cooler communicates the lubricant fluid with the fifth passage.

The above mentioned and other features of this invention, and the manner of attaining them, will become more apparent and the invention itself will be better understood by reference to the following description of embodiments of the invention taken in conjunction with the accompanying drawings.

BRIEF DESCRIPTION OF THE DRAWINGS

FIG. 10A is a schematic view of the flow of lubricant in an engine of the prior art;

FIG. 10B is a schematic view the engine of FIG. 10A equipped with a cooler adapter of the prior art; and FIG. 10C is a schematic view of another engine of the prior art.

Figure 1:
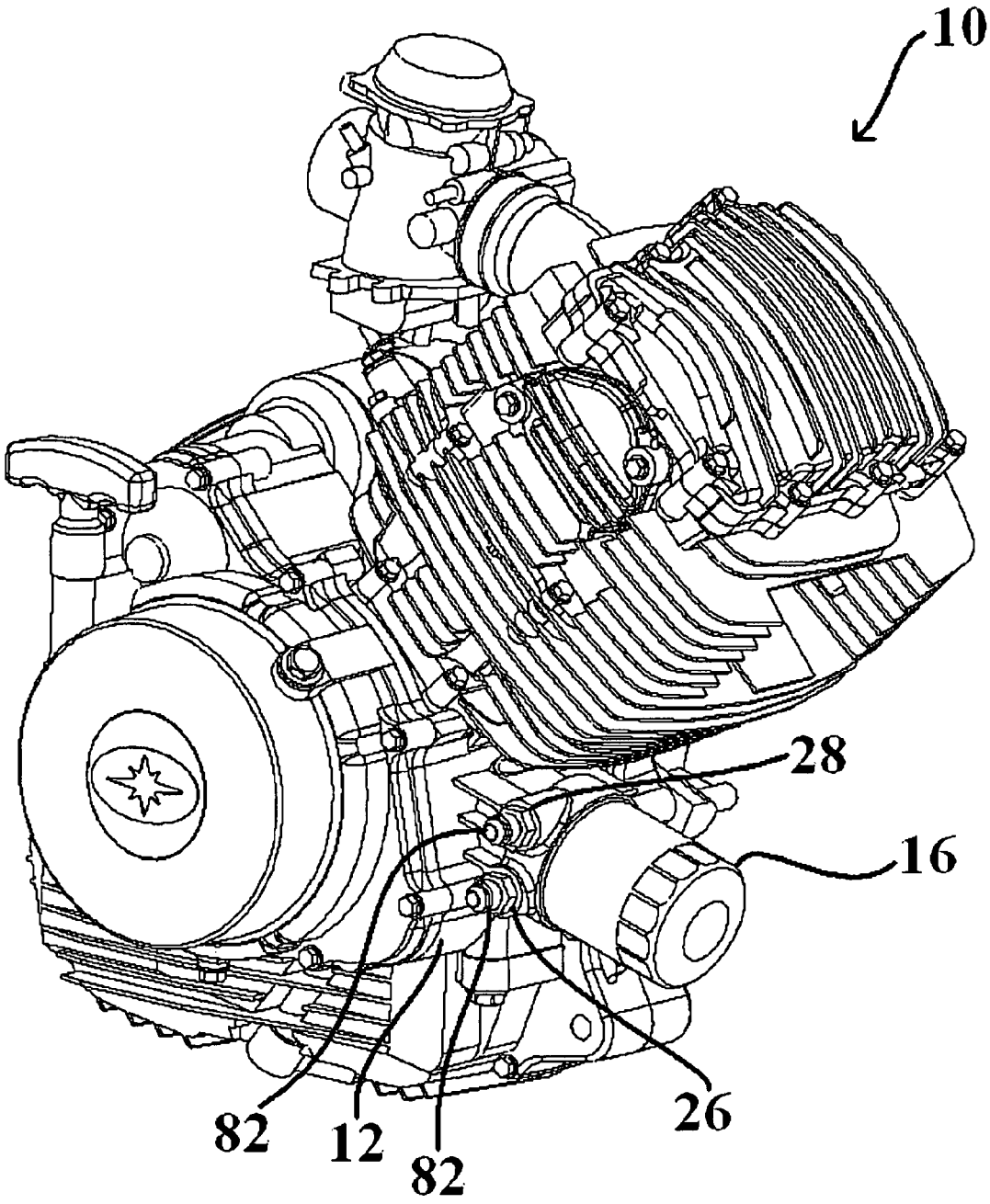
FIG. 1 is a perspective view of an engine of a vehicle according to one embodiment of the present disclosure.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF EMBODIMENTS OF THE INVENTION

The embodiments disclosed below are not intended to be exhaustive or to limit the invention to the precise forms disclosed in the following detailed description. Rather, the embodiments are chosen and described so that others skilled in the art may utilize their teachings.

As illustrated in FIGS. 10A and 10B, conventional engines typically include, among other things, an engine housing 312 and a lubricant filter 316. Engine housing 312 includes inlet passage 322 and outlet passage 324 through which lubricant flows to and from engine housing 312. Lubricant filter 316 includes inlet port 352 and outlet port 354, which are fluidly coupled to outlet passage 324 and inlet passage 322, respectively, of engine housing 312. Lubricant circulates between engine housing 312 and filter 316 along the path of the arrows shown in FIG. 10A. That is, lubricant is discharged from engine housing 312 via outlet passage 324 and enters filter 316 via inlet port 352. The lubricant is passed through filter member 356 to remove any debris within the lubricant and exits filter 316 via outlet port 354. Lubricant returns to engine housing 312 via mounting bolt 360 through channel 366 to inlet passage 322.

When operating at high temperatures, it may be desirable to cool the lubricant circulating through the engine. As illustrated in FIG. 10B, this is achieved by coupling a remote lubricant cooler device 372 to engine housing 312 and bypassing the flow of the lubricant such that the lubricant flows through cooler 372 prior to entering filter 316. This involves the installation of adapter 390, which is capable of coupling with inlet and outlet cooler lines 374, 376 of cooler 372. Filter 316 is removed, adapter 390 is mounted in its place on engine housing 312 and filter is then mounted on adapter 390. Adapter 390 includes a first fluid channel 328, a fluid inlet channel 326 and a second fluid outlet channel 330. When adapter 390 is mounted on engine housing 312, first fluid channel 328 is in fluid communication with outlet passage 324 and is adapted to fluidly couple with inlet cooler line 374. Fluid inlet channel 326 is adapted to fluidly couple with outlet cooler line 376 and fluid outlet channel 330 is in fluid communication with inlet port 352 of filter 316. With adapter 390 and cooler 372 installed, lubricant circulates along the path of the arrows shown in FIG. 10B. More specifically, lubricant flows from engine housing 312 via outlet passage 324 and enters first fluid channel 328 of adapter 390. Lubricant then flows through first fluid channel 328 and inlet line 374 to cooler 372, where the lubricant is cooled. Lubricant exits cooler 372 via outlet line 376 and enters adapter 390 via fluid inlet channel 326. Lubricant then flows from fluid inlet channel 326 through fluid outlet channel 330 to filter 316 via inlet port 352. The lubricant is filtered of debris and then discharged from filter 316 through filter outlet port 354 and flows back to engine housing 312 via mounting bolt 360 through channel 366 to inlet passage 322. As illustrated in FIGS. 10A and 10B, equipping the illustrated conventional engine with remote cooler 372 requires the installation of adapter 390 and external cooling lines.

Referring to FIG. 10C, a known engine is illustrated and includes engine housing 412 and filter 416. Engine housing 412 includes first and second inlet passages 422, 426 and first, second and third outlet passages 424, 428, 430. First and second outlet passages 424, 428 and first inlet passage 422 are fluidly coupled with the interior space of engine housing 412. First outlet passage 424 and first inlet passage 422 are in fluid communication with filter 416. Third outlet passage 430 is in fluid communication with both second inlet passage 426 of engine housing 412 and inlet port 452 of filter 416. To equip the engine with remote cooler 472, steel ball 490 is pressed into first outlet passage 424, thereby directing the flow of lubricant fluid from engine housing 412 to inlet cooler line 474. The lubricant flows through inlet cooler line 474 to remote cooler 472 where the lubricant is cooled. The lubricant flows from cooler 472 to engine housing via outlet line 476 and enters second inlet passage 426. The lubricant then flows from second inlet passage through third outlet passage 430 and enters filter 416 via inlet port 452. The lubricant passes through filter member 456 and then exits the filter 416 through filter outlet port 454 and flows back to engine housing via mounting bolt 460 through channel 466 to first inlet passage 422. It may be difficult to press and seal ball 490 in passage 424. Once ball 490 is pressed in, it may be difficult to remove and, thus, it is difficult to convert the engine to bypass cooler 472 when lubricant cooling is not needed.

Figure 2:
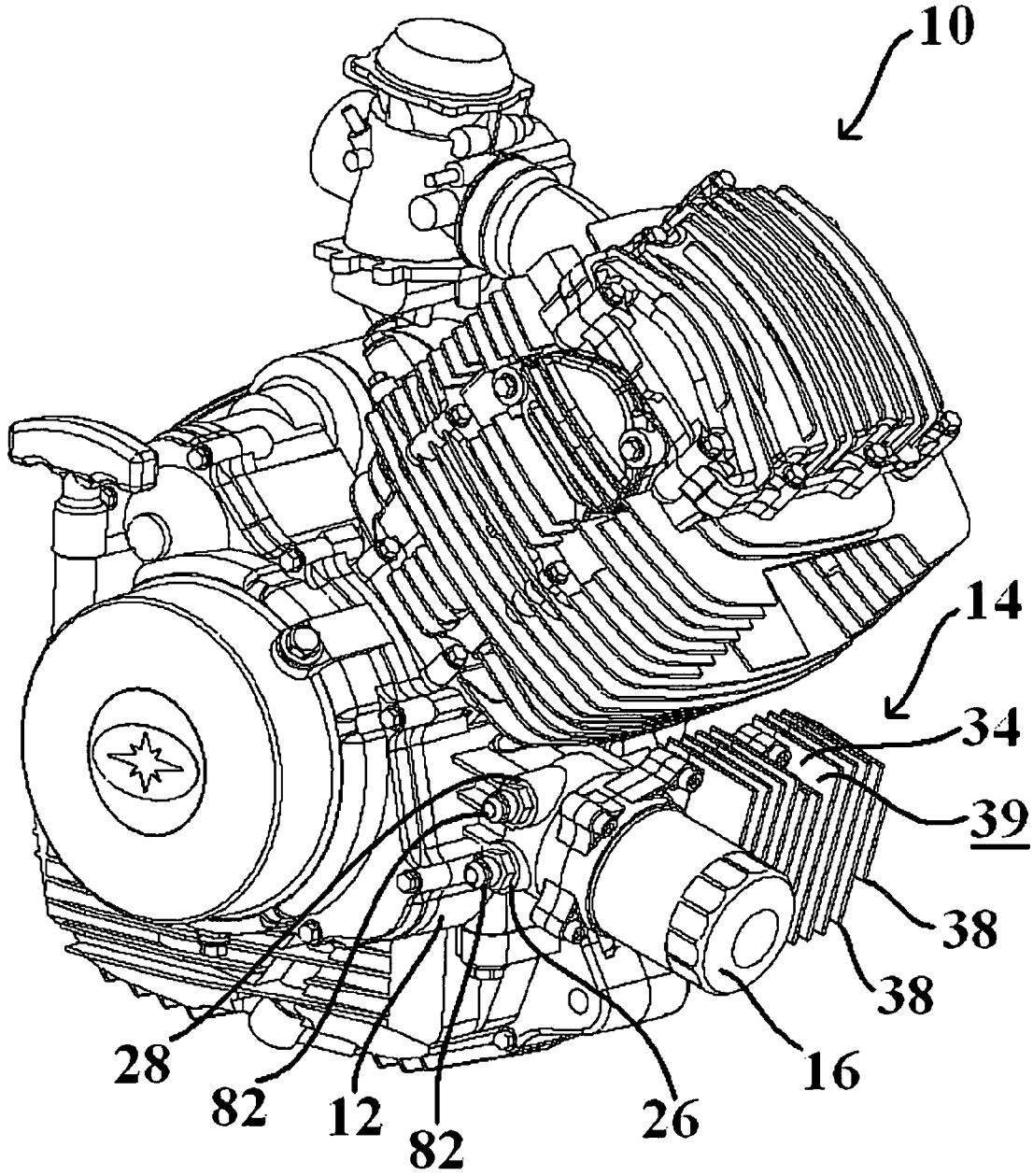
FIG. 2 is a perspective view of an engine of a vehicle according to another embodiment of the present disclosure.
Figure 9:
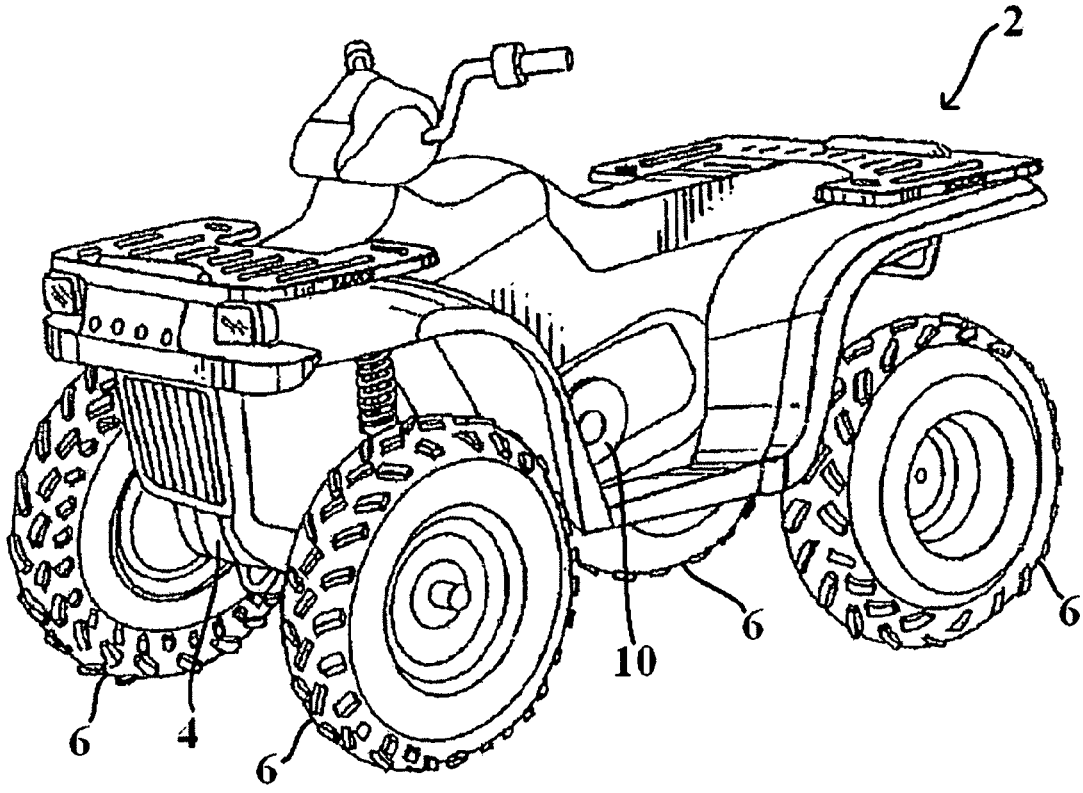
FIG. 9 is a perspective view of a vehicle of the present disclosure.

Referring to FIGS. 1 and 2, engine 10 in accordance with one embodiment of the present disclosure will now be described. Engine 10 is adapted for use in a vehicle capable of transporting a person. Such vehicles may include motorcycles, all-terrain vehicles (ATVs), utility vehicles (UVs) and snowmobiles. Engine 10 may be supported by the chassis of the vehicle in any known manner. Engine 10 is adapted to provide power to the traction device (i.e. wheels, track drive, or endless belt drive) of the vehicle to thereby propel the vehicle. For instance, referring to FIG. 9, engine 10 may be adapted for use in propelling/driving all-terrain vehicle (ATV) 2. Engine 10 is supported by chassis 4 and is operably coupled to traction devices or wheels 6 to provide power thereto.

Turning back to FIGS. 1 and 2 engine 10 includes engine housing 12, which houses the moving parts of engine 10. Engine housing 12 defines interior volume (not shown), which contains a lubricant fluid, such as oil, for lubricating the moving parts of engine 10. External lubricant filter component 16 is mounted to engine housing 12 and is in fluid communication with the interior volume of engine housing 12 to allow lubricant to circulate therebetween, as described in further detail below. As shown in FIG. 2, engine 10 may optionally include lubricant cooler 14, which is mounted to engine housing 12. As discussed in further detail below, lubricant cooler 14 is adapted to receive and cool lubricant from engine housing 12.

Turning specifically to FIGS. 1-3 and 4A-4B, engine housing 12 includes first inlet passage 22 and first outlet passage 24, each of which is in fluid communication with the interior volume defined by engine housing 12 to thereby communicate lubricant fluid to and from the interior volume of engine housing 12. Engine housing 12 also includes second inlet passage 26, second outlet passage 28 and third outlet passage 30. Second outlet passage 28 is in fluid communication with the interior volume of engine housing 12 to thereby communicate lubricant fluid from the interior volume of engine housing 12. Third outlet passage 30 is in fluid communication with second inlet passage 26.

Figure 4A:
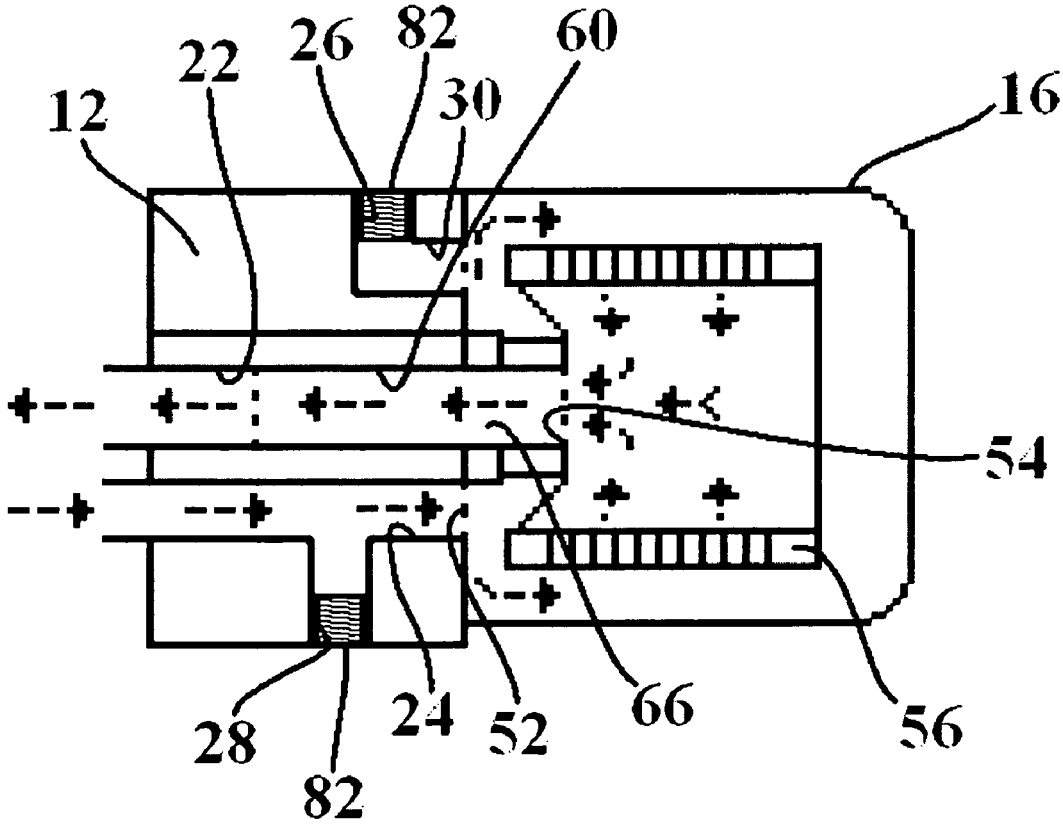
FIG. 4A is a schematic diagram of the engine of FIG. 1 in a first configuration and the flow of lubricant in the first configuration.
Figure 4B:
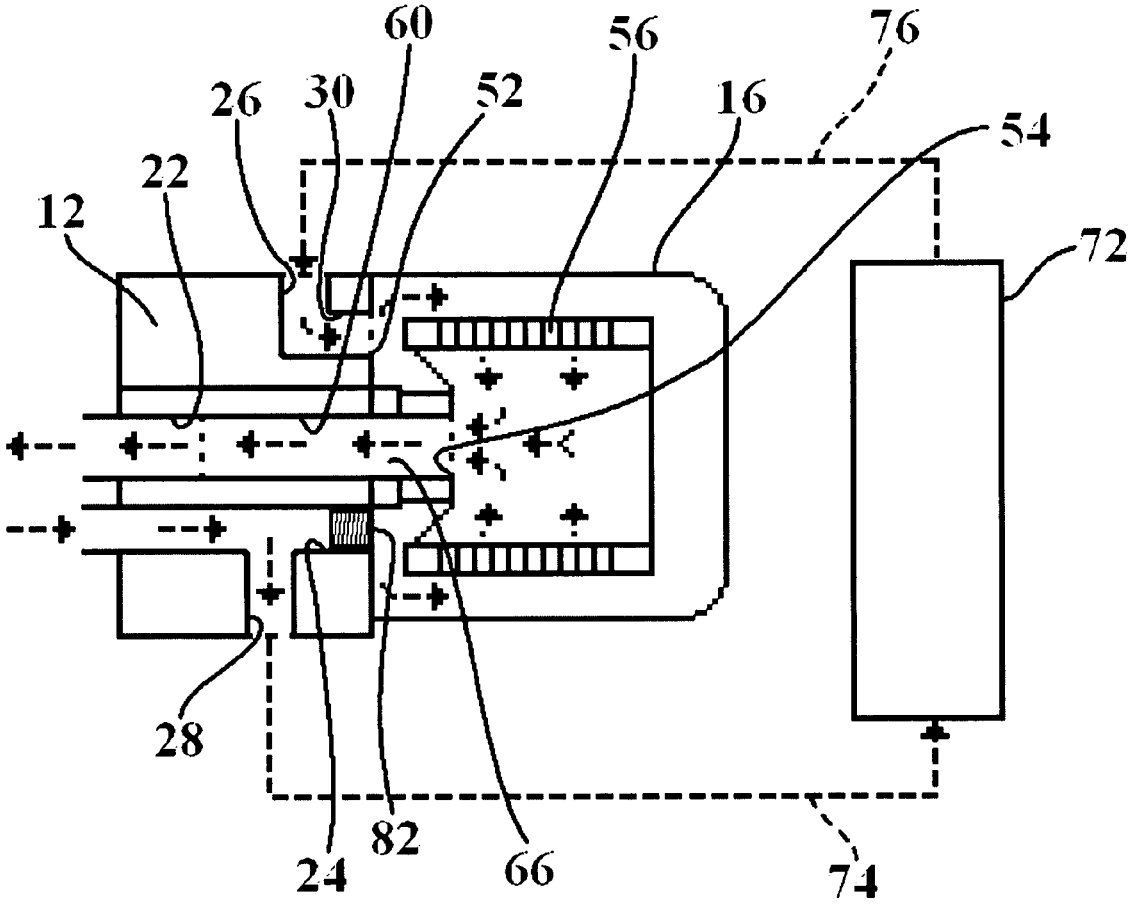
FIG. 4B is a schematic diagram of the engine of FIG. 1 in a second configuration and the flow of lubricant in the second configuration.

Referring still to FIGS. 4A and 4B, lubricant filter 16 includes inlet port 52, which is in fluid communication with first and third outlet passages 24, 30 of engine housing 12, and outlet port 54, which is in fluid communication with first inlet passage 22 of engine housing 12. Lubricant filter 16 also includes filter member 56 separating inlet port 52 from outlet port 54.

Figure 3:
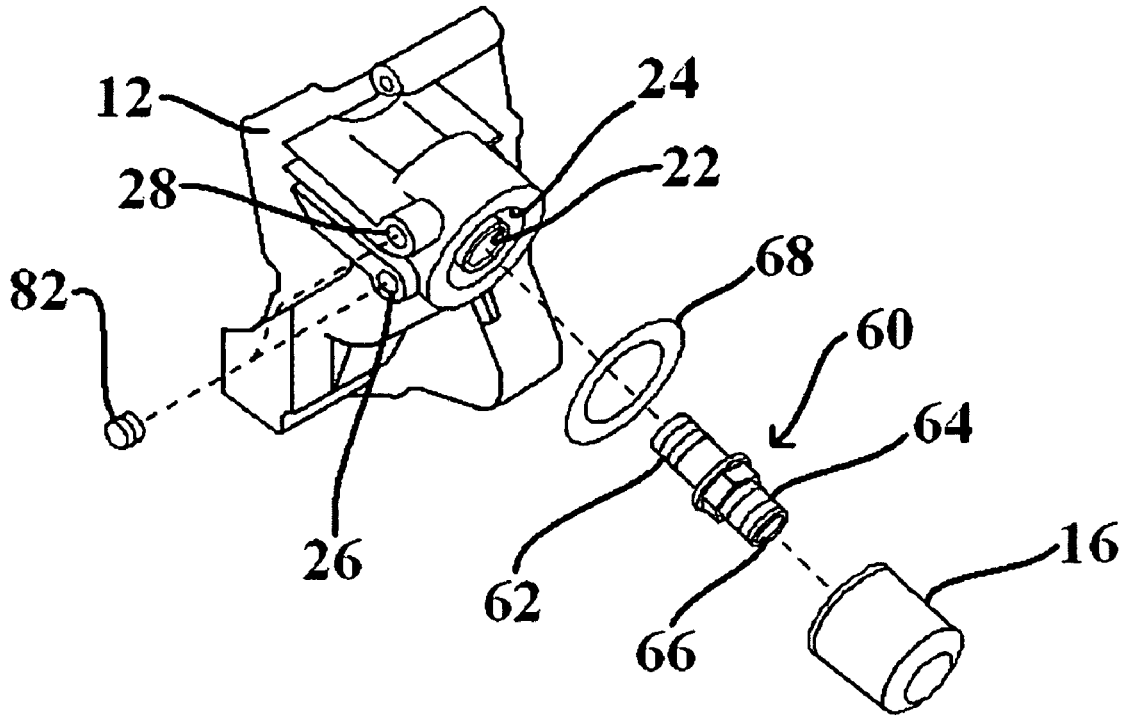
FIG. 3 is a partial exploded view of a portion of the engine of FIG. 1.
Figure 5:
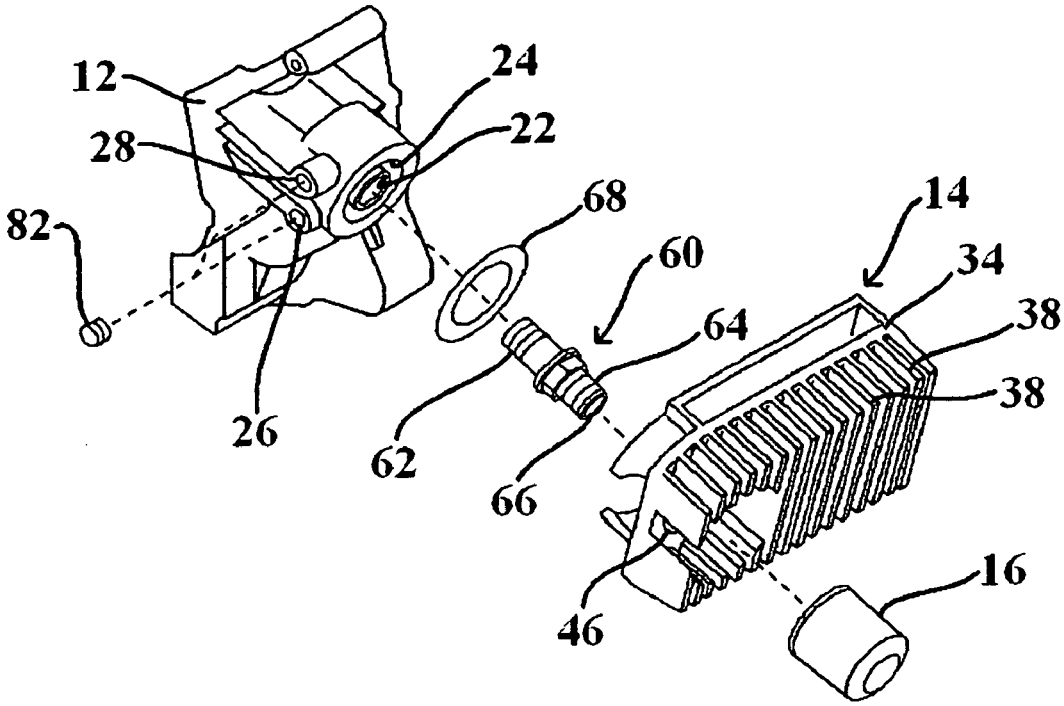
FIG. 5 is a partial exploded view of a portion of the engine of FIG. 2.

As shown in FIG. 3, lubricant filter 16 is mounted to engine housing 12 by fastener 60. Fastener 60 includes first end 62, opposing second end 64 and channel 66 extending therethrough from first end 62 to second end 64. First end 62 is configured to securely engage with first inlet passage 22 of engine housing 12, while second end 64 is configured to securely engage with outlet port 54 (FIG. 4A) of lubricant filter 16. For instance, first and second ends 62, 64 may engage with first inlet passage 22 and outlet port 54, respectively, in a threaded engagement. Seal 68 is positioned between lubricant filter 16 and engine housing 12. As described in further detail below, fastener 60 is configured to also mount lubricant cooler 14 to engine housing 12 (FIG. 5).

As illustrated in FIG. 4B, engine 10 is adapted to be coupled to remote lubricant cooler 72, which is located at a position remote from engine 10. Second inlet passage 26 and second outlet passage 28 are configured to fluidly couple with outlet line 76 and inlet line 74, respectively. Inlet and outlet lines 74, 76 are coupled with remote lubricant cooler 72 and are adapted to communicate lubricant to and from remote lubricant cooler 72. As illustrated in FIGS. 1-3 and 4A-4B, plugs 82 are configured to be received in and fluidly block first outlet passage 24, second inlet passage 26 and second outlet passage 28. More particularly, plugs 82, first outlet passage 24, second inlet passage 26 and second outlet passage 28 are threaded such that plugs 82 may be threadedly received in passages 24, 26, 28. Plugs 82 are removable and replaceable in one or more of passages 24, 26, 28 to thereby convert the engine between a first configuration shown schematically in FIG. 4A, and a second configuration shown schematically in FIG. 4B.

Referring to FIG. 4A, in the first configuration plugs 82 are securely received within and block both second inlet passage 26 and second outlet passage 28. In this first configuration, the flow or circulation of the lubricant is directed along the path of the arrows. More specifically, lubricant fluid flows from the interior volume of engine housing 12 via first outlet passage 24. In this first configuration, second outlet passage 28 is blocked by plug 82 thereby preventing lubricant fluid from exiting engine housing via second outlet passage 28. Lubricant fluid then enters lubricant filter 16 via inlet port 52 and flows through filter member 56, where debris is filtered from the lubricant fluid. Lubricant fluid then exits lubricant filter 16 via outlet port 54, flows through channel 66 of fastener 60 and enters the interior volume of engine housing 12 via first inlet passage 22.

Turning now to FIG. 4B, in the second configuration, plugs 82 have been removed from second inlet and second outlet passages 26, 28 and outlet line 76 and inlet line 74 have been respectively coupled to second inlet and second outlet passages 26, 28. One of plugs 82 is securely received within first outlet passage 24. In the second configuration, the circulation of lubricant fluid is directed along the path of the arrows illustrated in FIG. 4B. More specifically, lubricant fluid flows from the interior volume of engine housing 12 via second outlet passage 28 and to remote lubricant cooler 72 via inlet line 74. Lubricant is cooled within remote cooler 72, which may be any known cooler device capable of cooling lubricant fluid. Lubricant exits remote cooler 72 via outlet line 76 and flows through second inlet passage 26. Lubricant fluid then flows from second inlet passage 26 through third outlet passage 30. Lubricant fluid flows from third outlet passage 30 to lubricant filter via inlet port 52. Lubricant fluid then flows through filter member 56 where debris is filtered from the lubricant. Lubricant fluid is discharged from lubricant filter 16 via outlet port 54 and then flows through channel 66 of fastener 60 and into the interior volume of engine housing 12 via first inlet passage 22. Of course, if desired the lubricant flow could be reversed such that the lubricant is filtered prior to being cooled. For instance, the lubricant could exit engine housing 12 via inlet channel 22, travel through filter 56, flow through outlet port 30, inlet port 26 and outlet line 76 to the remote cooler 72 where it is cooled. Then return to engine housing 12 via outlet passage 28 through inlet line 74.

As illustrated in FIGS. 3, 4A and 4B and described above, engine 10 may be coupled to a remote cooler 72 without the installation of the conventional adapters by removing plugs 82 from second inlet and second outlet passages 26, 28 and connecting outlet and inlet lines 76, 74 respectively thereto. One of plugs 82 is relocated to first outlet passage 24 to achieve proper circulation of the lubricant fluid through engine housing 12, lubricant filter 16 and remote cooler 72. Plugs 82 are threaded to allow for simple removal and installation and to securely block the passage. In some arrangements, both plugs 82 may be stored in passage 24 or a separate location may be available for the second plug so it is not misplaced.

Turning now to FIGS. 2, 5 and 6A-6B, engine 10 may include lubricant cooler or heat exchanger 14 mounted directly to engine housing 12. Engine-mounted lubricant cooler 14 includes cooler housing 34, which defines interior space 36 in the form of a heat exchange passage or channel. A plurality of spaced-apart fins 38 extend outwardly from cooler housing 34 and are adapted to transfer heat from the contents (lubricant) in interior space 36 to the ambient air surrounding fins 38. Engine-mounted lubricant cooler 14 also includes first inlet opening 40 and outlet opening 44, each of which is in fluid communication with interior space 36. When lubricant cooler 14 is mounted to engine housing 12, first inlet opening 40 is in fluid communication with first and third outlet passages 24, 30, respectively, of engine housing 12. Of course, lubricant cooler could include two separate inlet openings that respectively mate with first and third outlet passages 24, 30. Outlet opening 44 is in fluid communication with inlet port 52 of lubricant filter 16.

As illustrated in FIG. 5, fastener 60 is configured to mount both lubricant cooler 14 and lubricant filter 16 to engine housing 12. Engine-mounted lubricant cooler 14 includes fastener receiving hole 46 extending therethrough and adapted to receive fastener 60. First end 62 of fastener 60 is securely received in first inlet passage 22. Second end 64 extends through fastener receiving hole 46 and is securely received in outlet port 54 of lubricant filter 16. As lubricant filter 16 is tightened about second end 64 of fastener 60, lubricant cooler 14 is sealingly compressed between and against lubricant filter 16 and engine housing 12. Filter 16 may include a tool engaging configuration, such as a hex-head or tool-engaging recess, to facilitate removal and installation.

Figure 6A:
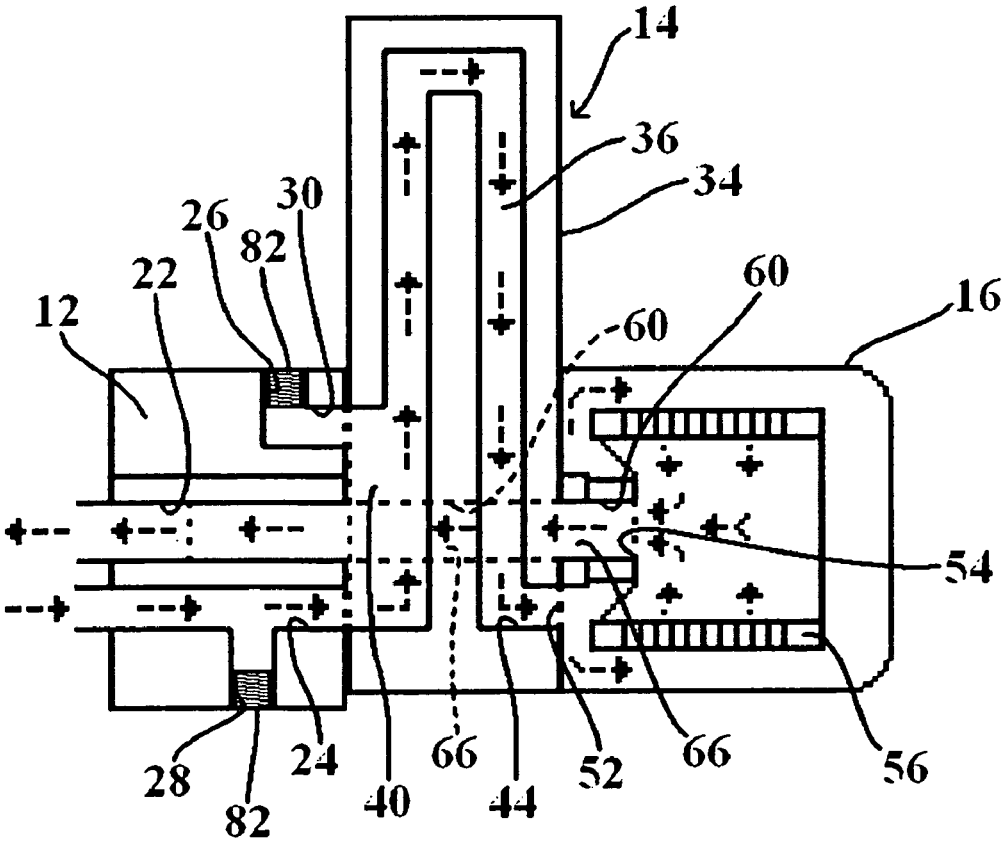
FIG. 6A is a schematic diagram of the engine of FIG. 2 in a first configuration and the flow of lubricant in the first configuration.
Figure 6B:
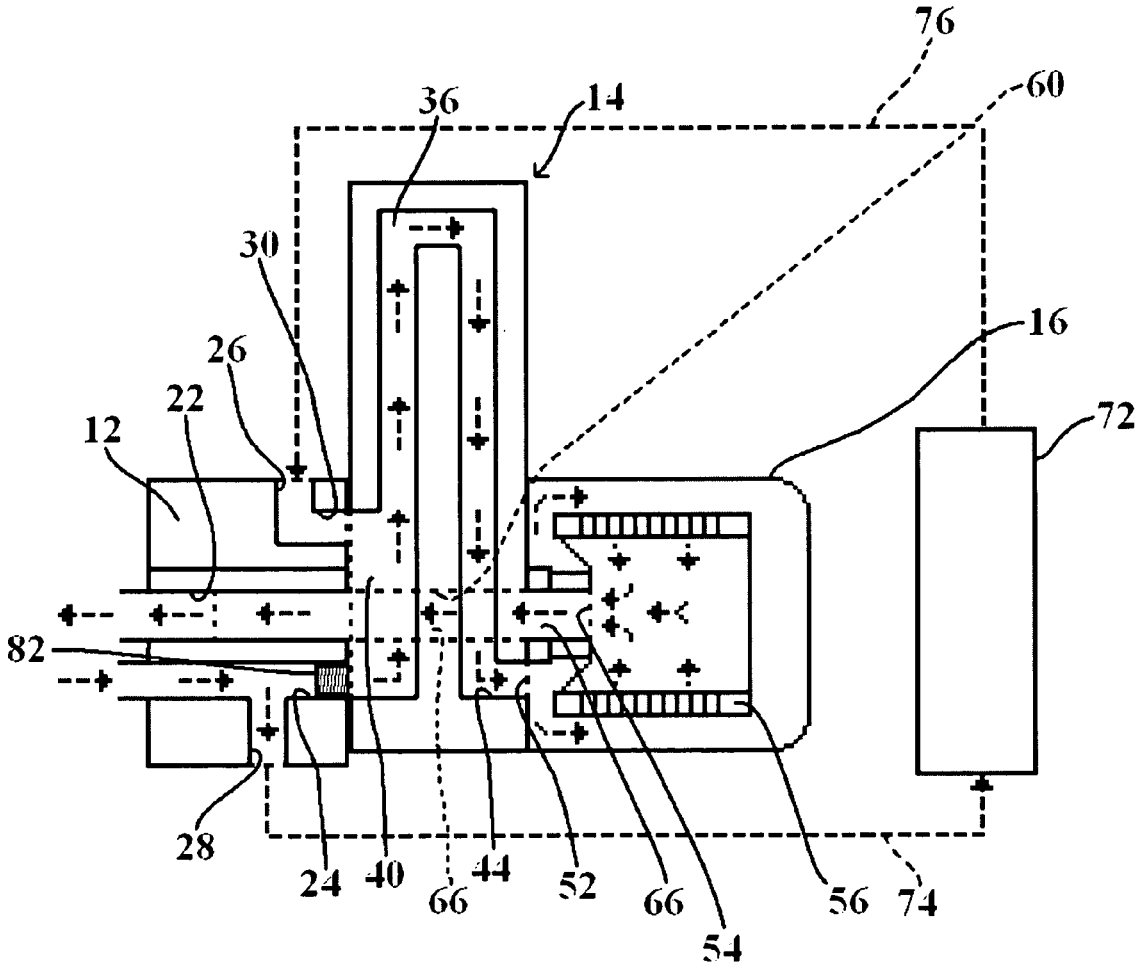
FIG. 6B is a schematic diagram of the engine of FIG. 2 in a second configuration and the flow of lubricant in the second configuration.

As described above with respect to the embodiment of FIGS. 4A and 4B, with lubricant cooler 14 mounted thereon, engine 10 is still convertible between a first configuration shown in FIG. 6A and a second configuration shown in FIG. 6B by installing, removing and/or relocating plugs 82. Referring now to FIG. 6A, in the first configuration, plugs 82 are securely received within second outlet passage 28 and second inlet passage 26. In this first configuration, the circulation of lubricant fluid is directed along the path of the arrows shown in FIG. 6A. More specifically, lubricant fluid is discharged from engine housing 12 via first outlet passage 24. Lubricant fluid then enters lubricant cooler 14 via inlet opening 40 and flows through interior space 36 wherein heat is transferred from lubricant fluid by fins 38 (FIG. 5). Lubricant fluid exits interior space 36 via outlet opening 44 and enters lubricant filter 16 via inlet port 52. Lubricant fluid flows through filter member 56 where debris is filtered from lubricant fluid. Lubricant fluid then exits filter 16 through outlet port 54, flows through channel 66 of fastener 60 and enters interior volume of engine housing 12 via first inlet passage 22. Of course, if desired the lubricant flow could be reversed such that the lubricant is filtered prior to being cooled as earlier described.

In the second configuration shown in FIG. 6B, plugs 82 are removed from second inlet and second outlet passages 26, 28 and engine housing 12 is fluidly coupled to a second, remote cooler 72 by coolant inlet and outlet lines 74, 76. One of plugs 82 is securely received in first outlet passage 24 to block the flow of lubricant therethrough. In this second configuration, lubricant fluid circulates in the direction of the arrows shown in FIG. 6B. More specifically, lubricant fluid is discharged from interior volume of engine housing 12 via second outlet passage 28. Fluid flows to remote cooler 72 via coolant inlet line 74 and flows from remote cooler 72 via coolant outlet line 76. Lubricant fluid then flows through second inlet passage 26 and through third outlet passage 30. Lubricant fluid enters engine mounted cooler 14 via inlet opening 40. Lubricant fluid then flows through interior space 36 wherein heat is transferred from lubricant fluid by fins 38 (FIG. 5). Lubricant fluid exits interior space 36 via outlet opening 44 and enters lubricant filter 16 via inlet port 52. Lubricant fluid flows through filter member 56 where debris is filtered from lubricant fluid. Lubricant fluid then exits filter 16 through outlet port 54, flows through channel 66 of fastener 60 and enters interior volume of engine housing 12 via first inlet passage 22. Of course, if desired the lubricant flow could be reversed such that the lubricant is filtered prior to being cooled as earlier described.

As demonstrated in FIGS. 5, 6A and 6B, engine 10, with first lubricant cooler 14 mounted thereon, may be coupled to second, remote cooler 72 under high-heat operating conditions when additional lubricant cooling is needed. In addition, as illustrated in FIGS. 2, 5 and 6A, lubricant cooler 14 is adapted to be mounted directly to engine housing 12, thereby eliminating the need for the external coolant lines required when using a single lubricant cooler remote from the engine housing. Elimination of the external coolant lines reduces costs and weight of the vehicle. The manufacture of the vehicle is also eased by eliminating the need to install and route the external coolant lines. Finally, elimination of the external coolant lines may improve durability and longevity of the vehicle and reduce maintenance costs, as routine replacement of external coolant lines is not required.

Figure 8:
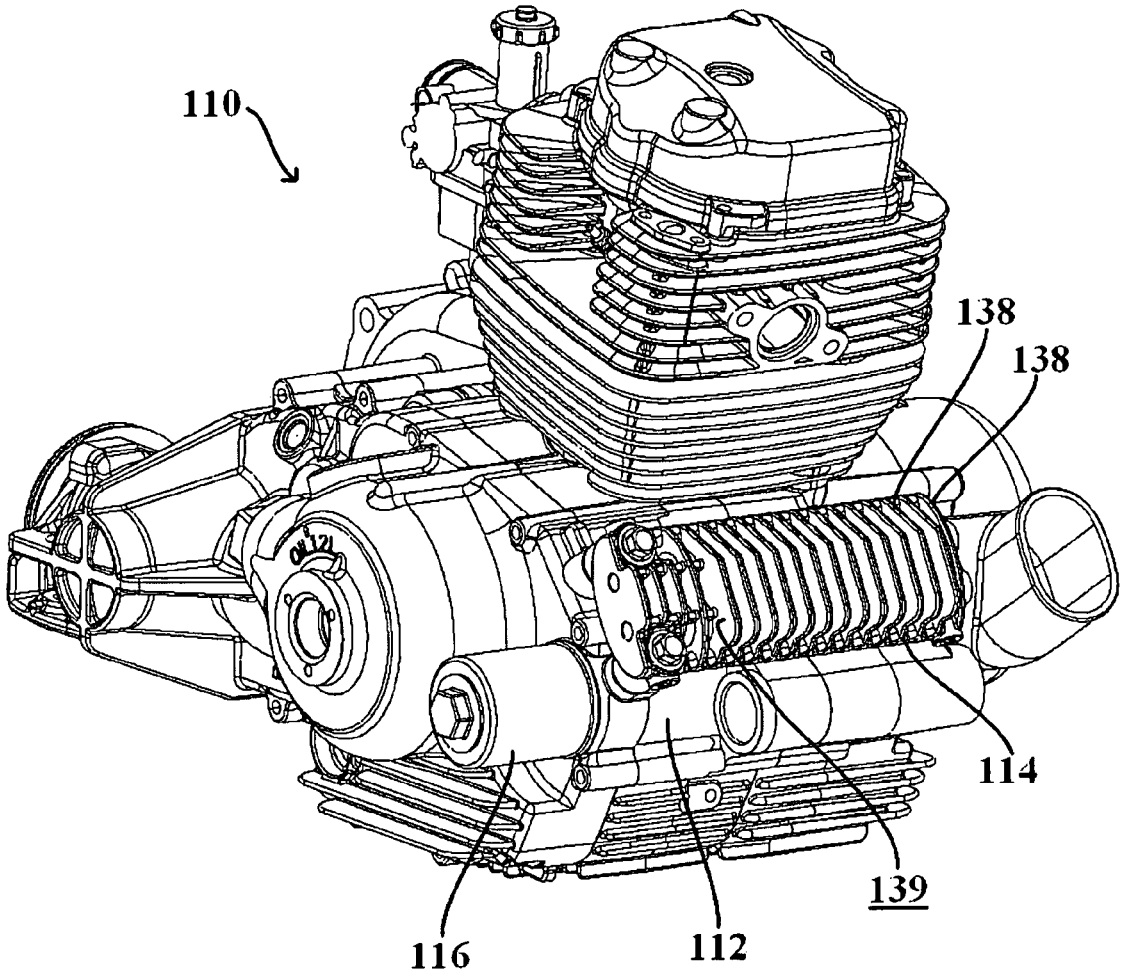
FIG. 8 is a perspective view of an engine of a vehicle according to another embodiment of the present disclosure.

Also, as shown in FIG. 5, lubricant cooler may be mounted to engine housing fastener 60, which is also used to mount filter 16 to engine housing 12. By using single fastener 60 to mount both filter 16 and cooler 14 to engine housing 12, the assembly of the vehicle is simplified. Although filter 16 and cooler 14 may be mounted to engine 12 using single fastener 60, such a configuration is not necessary. For instance, as shown in FIG. 8, engine 110 includes engine housing 112. Filter 116 is mounted to engine housing 112 separately from engine-mounted lubricant cooler 114. In this embodiment, the outlet opening (not shown) of cooler 114 is in fluid communication with the first inlet passage (not shown) of engine housing 112. In some embodiments, the lubricant flow could be cooled prior to filtering such that the outlet opening (not shown) of the filter could be in fluid communication with the first inlet passage (not shown) of the engine housing 112.

Referring to FIGS. 2 and 8, it should be noted that engine-mounted lubricant coolers 14, 114 are configured such that when mounted to engine 10, 110, fins 38, 138 preferably extend substantially vertical to the ground or the horizon. This configuration minimizes the collection of dirt and debris on the heat exchange surfaces 39, 139 of fins 38, 138. However, it is contemplated that the fins may be mounted substantially horizontal or parallel to the ground or the horizon in some embodiments to increase air flow across them. Engine-mounted coolers 14, 114 may be manufactured by any known methods and formed from any material suitable for transferring and withstanding the heat of the lubricant fluid. For instance, engine-mounted coolers 14, 114 may be formed of metal such as steel, aluminum or alloys thereof and may be formed by extrusion, casting or machining processes.

Figure 7:
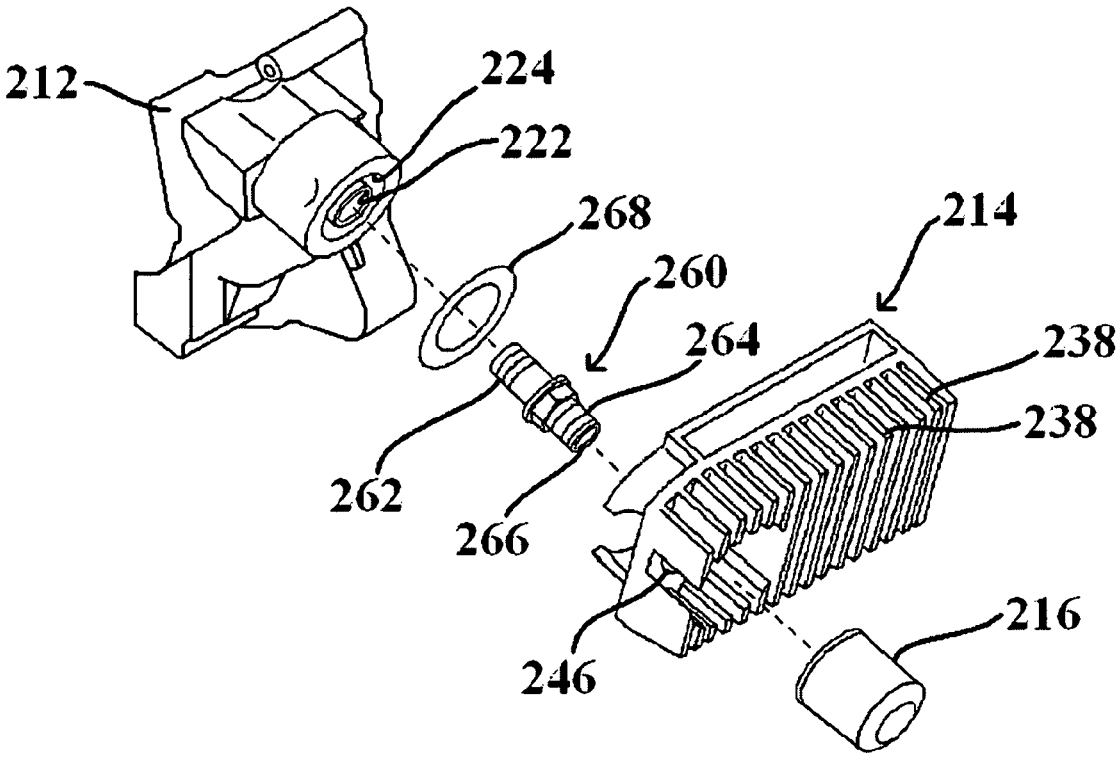
FIG. 7 is a partial exploded view of a portion of an engine of a vehicle according to another embodiment of the present disclosure.

Turning to FIG. 7, the present disclosure also contemplates an engine having an engine-mounted lubricant cooler 214 not necessarily convertible between first and second configurations. As shown in FIG. 7, the engine includes engine housing 212 having inlet passage 222 and outlet passage 224. Both lubricant cooler 214 and lubricant filter 216 are mounted to engine housing by fastener 260, which includes first end 262, opposing second end 264 and channel 266 extending therethrough from first end 262 to second end 264. First end 262 is securely received within inlet passage 222, while second end 264 extends through fastener receiving opening 246 in lubricant cooler 214 and securely engages with the outlet port (not shown) of filter 216. Seal 268 is positioned between cooler 214 and housing 212 to ensure a sealed engagement therebetween. In some arrangements, a seal may not be needed and/or a second seal between the oil filter and the lubricant cooler may be required. Lubricant cooler 214 includes a plurality of outwardly extending fins 238, which transfer heat from the contents of lubricant cooler 214 to the air surrounding fins 238.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A vehicle for transporting a person, the vehicle including a chassis;

a traction device adapted to contact the ground and propel the chassis, and an engine supported by the chassis and providing power to the traction device, the engine including an engine housing, a lubricant, and a first engine component external of the engine housing, the engine housing including a first lubricant passage, a second lubricant passage, a third lubricant passage, and a fourth lubricant passage;

the vehicle having a first configuration in which the second lubricant passage communicates lubricant with the engine component, the first lubricant passage communicates lubricant with the first engine component, the fourth lubricant passage is blocked with a plug, and the third lubricant passage is blocked with a plug; and the vehicle having a second configuration in which the second lubricant passage is plugged with at least one of the plugs, the fourth lubricant passage communicates lubricant with a second engine component external of the engine housing, and the third lubricant passage communicates lubricant with the second engine component.

2. The vehicle of claim 1 wherein the first and second engine components include a lubricant filter and a lubricant cooler.

3. The vehicle of claim 1 wherein the engine housing defines an interior volume for holding the lubricant, and each of the second lubricant passage, the fourth lubricant passage and the first lubricant passage is in fluid communication with the interior volume.

4. The vehicle of claim 1 wherein the engine housing includes a fifth lubricant passage in fluid communication with the third lubricant passage.

5. The vehicle of claim 4 wherein the fifth lubricant passage communicates lubricant with the first external engine component when the vehicle is in the second configuration.

6. The vehicle of claim 4 wherein at least one of the first and second external engine components is a first lubricant cooler, further comprising a second lubricant cooler mounted on the engine housing, the second lubricant cooler including a cooler housing defining an interior space and a plurality of heat fins extending outwardly from the cooler housing, the interior space of the cooler housing being in fluid communication with at least one of the first and second external engine components and the second and fifth lubricant passages, wherein when the vehicle is in the second configuration, the fifth lubricant passage communicates lubricant with at least one of the first and second external engine components and the third lubricant passage via the second lubricant cooler.

7. The vehicle of claim 1 wherein the plugs are threaded and at least three of the first, second, third, and fourth lubricant passages are threaded to threadingly receive one of the plugs.

8. A vehicle for transporting a person, the vehicle including a chassis;

an engine supported by the chassis and providing power to the propel the chassis, the engine including an engine housing and a lubricant; and a lubricant cooler mounted on the engine housing, the lubricant cooler including a cooler housing defining an interior space for the lubricant and a plurality of heat fins dissipating heat from the lubricant to air passing over the heat fins, wherein the engine housing includes a first inlet passage, a first outlet passage, a second inlet passage, a second outlet passage, and a third outlet passage in fluid communication with the second lubricant inlet passage, the interior space of the lubricant cooler is in communication with the first outlet passage and the third outlet passage, the vehicle is convertible between a first configuration wherein each of the second outlet passage and the second inlet passage is blocked with a plug and the lubricant flows from the engine housing to the interior space via first outlet passage and the interior volume receives the lubricant via the first inlet passage, and a second configuration wherein the first outlet passage is blocked with one of the plugs and both the second outlet passage and the second inlet passage are adapted to fluidly and remotely couple a second lubricant cooler to the engine housing.

9. The vehicle of claim 8 wherein the cooler housing includes an outer surface and the plurality of heat fins extend outwardly from the outer surface.

10. The vehicle of claim 8 wherein the plurality of fins are arranged vertically relative to the horizon.

11. The vehicle of claim 8 wherein the lubricant cooler is mounted to the engine housing by a fastener, the fastener is configured to engage with a lubricant filter to thereby mount both the lubricant filter and the lubricant cooler to the engine housing.

12. The vehicle of claim 11 wherein the fastener includes a cylindrical bolt having a first end, an opposite second end and a channel extending from the first end to the second end, the first end is engaged with a lubricant inlet passage in the engine housing, the bolt extends through an opening in lubricant cooler, and the second end is engaged with an inlet port of the lubricant filter, and the channel provides communication of the lubricant between the engine housing and the lubricant filter.

13. The vehicle of claim 8 wherein each of the plugs is threaded and each of the second outlet passage, the second inlet passage and the first outlet passage is threaded to threadingly receive on of the plugs.

14. A vehicle including:

an engine providing power to propel the vehicle, the engine including an engine housing defining an interior volume, the engine housing including a first passage in fluid communication with the interior volume, a second passage in fluid communication with the interior volume, a third passage, a fourth passage in fluid communication with the interior volume, and a fifth passage in fluid communication with the second lubricant inlet passage;

a first lubricant cooler mounted on the engine housing, the first lubricant cooler including a cooler housing defining an interior space and a plurality of heat fins, the interior space of the cooler housing in fluid communication with the second and fifth passages; and a lubricant fluid circulating between the interior volume of the engine housing and the interior space of the cooler housing;

the vehicle being convertible between a first configuration and a second configuration, wherein in the first configuration each of the third and fourth passages are blocked with a plug, and the lubricant fluid flows between the interior volume and the interior space via the second passage, the plurality of heat fins dissipating heat from the lubricant fluid in the interior space of cooler housing to air passing over the plurality heat fins, and the first passage communicates lubricant fluid with the interior volume; and wherein in the second configuration the second passage is blocked with one of the plugs, the third and fourth passages are fluidly and remotely engagable with a second lubricant cooler, the fourth passage capable of communicating the lubricant fluid from the interior volume to the second lubricant cooler, the third passage capable of communicating lubricant with the second lubricant cooler, and the interior space of the first lubricant cooler communicates the lubricant fluid with the fifth passage.

15. The vehicle of claim 14 wherein the first lubricant cooler is mounted to the engine housing by a fastener, the fastener is configured to engage with a lubricant filter to thereby mount both the first lubricant cooler and the lubricant filter to the engine housing.

16. The vehicle of claim 15 wherein the fastener includes a bolt having a first end, an opposite second end and a channel extending from the first end to the second end, the first end is engaged with the first passage in the engine housing, the bolt extends through an opening in the lubricant cooler, and the second end is engaged with an outlet port of the lubricant filter, the channel communicates the lubricant fluid with the lubricant filter and the first passage.

17. The vehicle of claim 14 wherein the plugs are threaded and at least three of the first, second, third, fourth, and fifth passages are threaded to threadingly engage with one of the plugs.

18. The vehicle of claim 14 wherein the plurality of fins extend outwardly from the cooler housing.

19. The vehicle of claim 14 wherein the plurality of fins are arranged vertically relative to the horizon.

* * * * *

UNITED STATES PATENT AND TRADEMARK OFFICE

CERTIFICATE OF CORRECTION

PATENT NO. : 7,621,251 B1
APPLICATION NO. : 11/372593
DATED : November 24, 2009
INVENTOR(S) : Courant et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 766 days.

Signed and Sealed this

Twenty-sixth Day of October, 2010

David J. Kappos

David J. Kappos
*Director of the United States Patent and Trademark Office*